United States Patent [19]

Slinsky

[11] Patent Number: 4,607,463

[45] Date of Patent: Aug. 26, 1986

[54] ADJUSTMENT MEANS FOR A DRILL BIT SHARPENING DEVICE

[76] Inventor: Albert Slinsky, 909 Aberdeen Ave., New Port Richey, Fla. 33552

[21] Appl. No.: 759,746

[22] Filed: Jul. 29, 1985

[51] Int. Cl.[4] ..... B24B 3/26

[52] U.S. Cl. ..... 51/219 R

[58] Field of Search ..... 51/219 R, 219 PC, 238 GG, 51/238 T

[56] References Cited

U.S. PATENT DOCUMENTS

| | | | |
|---|---|---|---|
| 1,585,984 | 5/1926 | Heim | 51/238 GG |
| 2,556,073 | 6/1951 | Dixon | 51/219 R |
| 2,758,430 | 8/1956 | Sprenzel | 51/219 R |
| 4,520,599 | 6/1985 | Slinsky | 51/219 R |

*Primary Examiner*—Harold D. Whitehead

*Attorney, Agent, or Firm*—Ronald E. Smith; Miguel A. Valdes

[57] ABSTRACT

An improvement to a drill bit sharpening apparatus in the form of a simple spacer that provides the space setting between a drill bit point and the surface of a grinding device. The spacer comprises an elongated strip made of hard material; the width of the strip is not uniform and diminishes at two portions of the strip. The slanting angle of the portions corresponds to the Z-distances travelled by a drill bit supporting member so as to accomplish the setting. The strip also has calibration marks on its surface corresponding to a set of drill bit diameters for a given point angle. The spacer completely replaces the disc shaped and rectangular shaped prior art spacers.

3 Claims, 4 Drawing Figures

ADJUSTMENT MEANS FOR A DRILL BIT SHARPENING DEVICE

BACKGROUND OF THE INVENTION

1. Field of the Invention

This invention relates, generally, to drill bit sharpening devices, and more particularly relates to an improvement to the travel limiting means of a drill bit sharpening device.

2. Description of the Prior Art

U.S. Pat. No. 4,520,599, issued Jan. 4, 1985 to the present inventor discloses a drill bit sharpener. The patent discloses two types of travel limiting means (spacers) which are used to calculate the correct spacing between a drill bit point and a grinding surface at a given point angle of the drill bit to be sharpened.

One of the aforesaid spacers consists of a rotatably mounted flat disc member. The disc member is provided with perforations or other markings which are arranged in a spiral-like configuration. These perforations correspond to cooperative settings of the disc and a stop member, in sixty-fourths of an inch, for drill bits of differing diameters to be pointed.

The other spacer consists of a flat, rectangular bit positioning member. The member is slotted to slidingly receive screw members. It also includes a trailing edge. For each point angle, there is provided a set of bit positioning members wherein the number of members in each set is equal to the number of perforations in the disc type spacer. Accordingly, the need to align a given perforation with a marking on the trailing edge of the stop member is obviated in this type of spacer.

There is a need for a much simpler and more straightforward type of spacer than the ones already in the art to reduce the number of parts in and to improve the drill bit sharpener.

It is the primary object of this invention to provide the space setting between a drill bit point and a grinding surface for a drill bit sharpener in the form of a simple mechanical means.

Another object of this invention is to provide a space setting which is visible at all times in the drill bit sharpener.

SUMMARY OF THE INVENTION

The invention accomplishes these and other objects by providing a spacer that comprises an elongate strip made of a hard material; the width of said strip diminishes from a maximum to a minimum at two separate portions of the strip so that one of its longitudinal edges has two slanted portions. The strip has calibration marks to perform the setting.

The novel spacer replaces the aforesaid disc type and rectangular type of spacers.

The invention provides several significant features and advantages. With prior art spacers, some parts of the drill bit sharpener have to be removed when setting the sharpener for drill bits of different diameters or when changing gauges. An important feature is that by using the spacer according to this invention there is no need to make such removal of parts.

An advantage of the spacer according to the invention is that the construction is much simpler than the types of the prior art. Another advantage is that a wider variety of materials can be utilized for its construction. Further advantages are that fewer parts are needed for the space setting when using the spacer according to this invention; and that the setting is visible at all times during the drill bit sharpening operation.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several view of the drawings.

DETAILED DESCRIPTION OF THE PREFERRED EMBODIMENT

Figure 1:
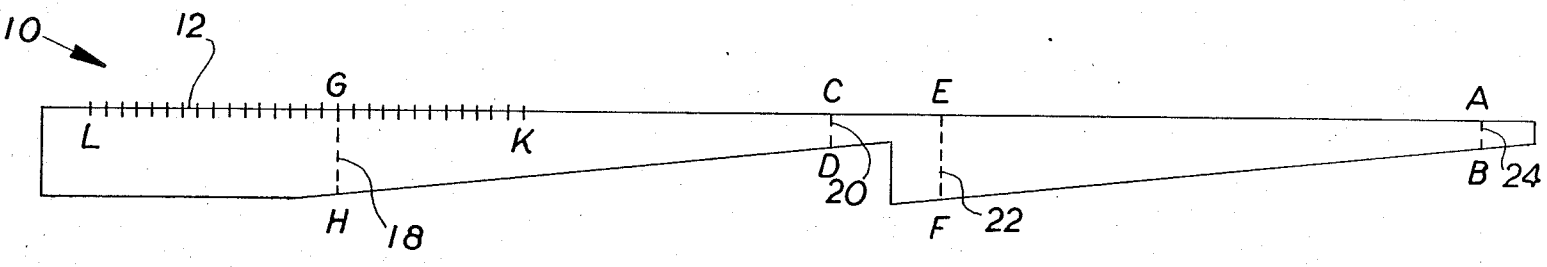
FIG. 1 is a top plan view of a spacer in accordance to the invention.

Referring now to FIG. 1, it will there be seen that an embodiment of the spacer is designated by the reference numeral 10 as a whole. Spacer 10 includes a calibrated scale 12 which has a calibration mark at point L for a drill bit with the largest diameter that can be sharpened on the inventive apparatus and a calibration mark at point K for the drill bit with the smallest diameter. A plurality of equidistantly spaced calibration marks between the aforesaid values are formed in spacer 10. Also spacer 10 has various widths that corresponds to "Z" distances (to be discussed later). Width 20, between points C and D, and width 24, between points A and B, which widths are equal to one another, correspond to the "Z" distance for the drill bit with the smallest diameter; width 18, between points G and H, and width 22, between points E and F, which are equal to one another, correspond to the "Z" distance for the drill bit with the largest diameter. The distances L-K, G-C and E-A correspond to X1X2 to be discussed later. Distances G-E and C-A correspond to the distance between the center of the stop pins 26 and 28 on slotted slide plate 30, to be discussed later in connection with FIG. 2. The distance between the stop pins 26 and 28 must be larger than the distance between the aforesaid widths 18 and 20 and the aforesaid widths 22 and 24. The calibrated scale 12 is located at an offset position in the drill bit sharpener (as shown in FIG. 2) so as to permit visibility during the sharpening operation.

Figure 2:
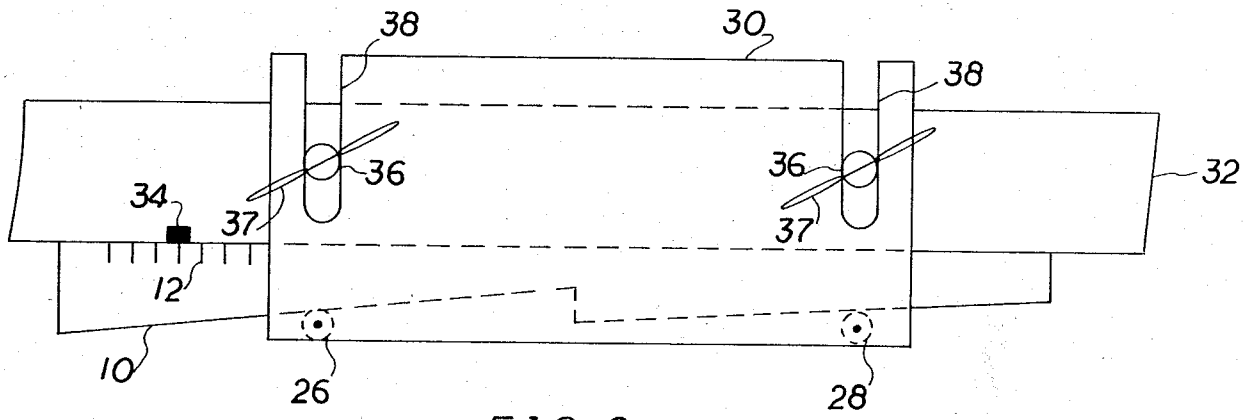
FIG. 2 is a top plan view of the spacer according to the invention in conjunction with the adjacent parts of the drill bit sharpener that complete the structure for the space setting operation.

FIG. 2 shows spacer 10 in mechanical association with a plate 30 and an angle iron 32. Iron 32 has a pointer 34 to align the calibration scale 12 of spacer 10 so as to accomplish the space setting for a drill bit sharpener. Plate 30 includes stop pins 26 and 28 which are kept in abutting relation to the longitudinal edge of spacer 10 having two inclined portions. The purpose of stop pins 26 and 28 is to stop the further movement of plate 30. Plate 30 is slotted as at 38, 38 to slidingly receive wing nut bolts 36 which are fixedly secured to angle iron 32. To perform space setting, wing nuts 37 are loosened and the spacer 10 is moved laterally so as to set the pointer 34 in the desired calibration mark of scale 12. This action will slidingly move the plate 30 accordingly. Finally, the nuts 37 are tightened and the setting is accomplished.

Figure 3:
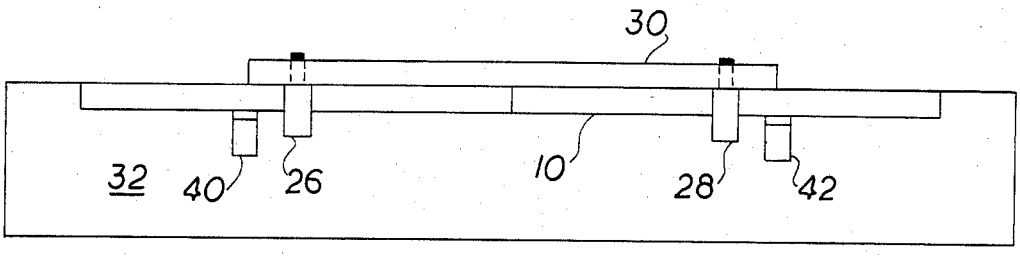
FIG. 3 is a side elevational view of the spacer and the adjacent parts illustrated in FIG. 2.

As shown in FIG. 3, the spacer 10 is slidingly moved on the top of spacer supports 40 and 42. Plate 50 is disposed in tight relation at its lower side to spacer 10, thereby partially holding spacer 10 in its position on the drill bit sharpener.

Figure 4:
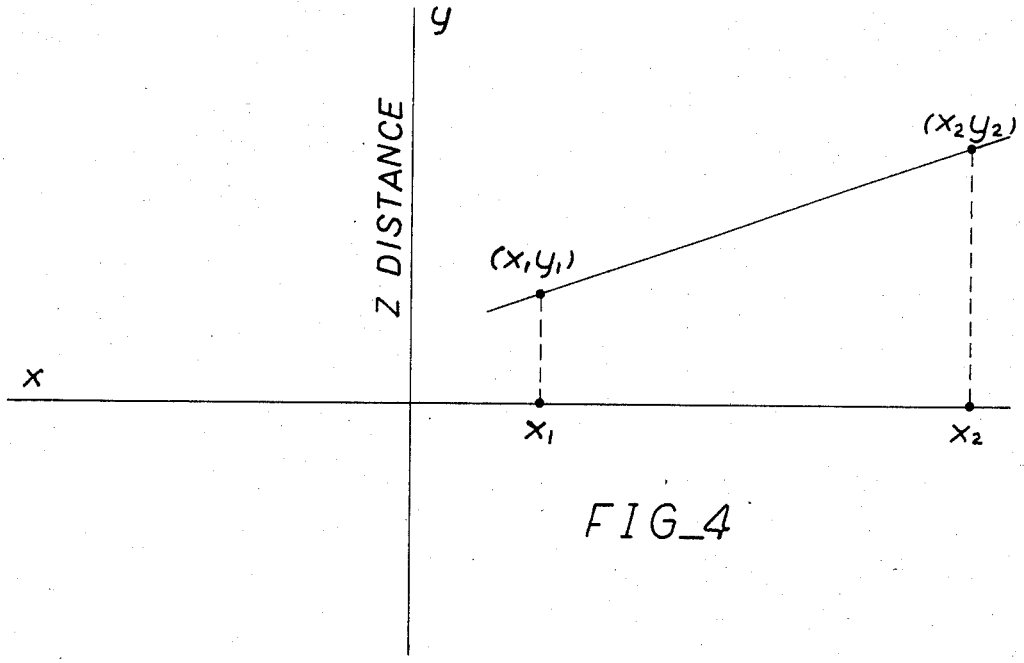
FIG. 4 is a graph, according to a mathematical linear equation, operative to determine the calibration marks for the spacing gauge.

FIG. 4 is a graphic illustration of the following linear equation:

$$Z = C + \cos(90 - B)\left(\frac{R}{\tan B} + \frac{R}{\tan(B - A)}\right) - \frac{(R(1) - R)\sin A}{\sin 45^\circ \sin(B - A)}$$

where:

A = ½ Helix angle

B = ½ Point angle

R(1) = radius of zero longitudinal gauge

R = radius of drill bit

C = constant (for construction convenience)

Z = linear distance

Still referring to FIG. 4, the slope of line (x1y1, x2y2) is constant. To determine this line it is necessary only to establish the location of two points. The points x1 and x2 correspond to the smallest and largest diameter, respectively, of the selected range of drill bits. For example, if x1 is 1/16" and x2 is ¼" it is only necessary that the "Z" distances for y1 and y2 be calculated in order to determine the line (x1y1, x2y2). Therefore, all diameter values within the range of 1/16" and ¼" may be calibrated by proportionately dividing the line (x1, x2) and the "Z" distances for each of these diameter values may be readily determined.

The aforestated formula has four variables, A, B, R(1) and R. For any given drill bit sharpener, "A" and "R(1)" are fixed, so they become constants, leaving "B" and "R" as the remaining variables. Then, for a given point angle, "B" becomes a constant and "R" may be assigned any desired bit diameter value along the x-axis of the graph of FIG. 4. The "Z" distance for each drill bit diameter value is determined along the y-axis. If the value of "B", or point angle, is changed, the slope of the line (x1y1, x2y2) will change. Therefore, for every point angle, a different set of "Z" distances is required.

The above formula is simulated mechanically by constructing a spacer in accordance with the teachings of this invention. Thus, the spacer 10 performs as an analog calculator. From the aforesaid analysis of the formula and graph of FIG. 4, it may be concluded that a drill bit sharpener with a number of available point angles requires an equal number of spacers, each having a corresponding set of drill bit diameter values (calibrated scale 12) and a set of "Z" distance values (as determined by the two slanted portions of spacer 10).

Figure 5:
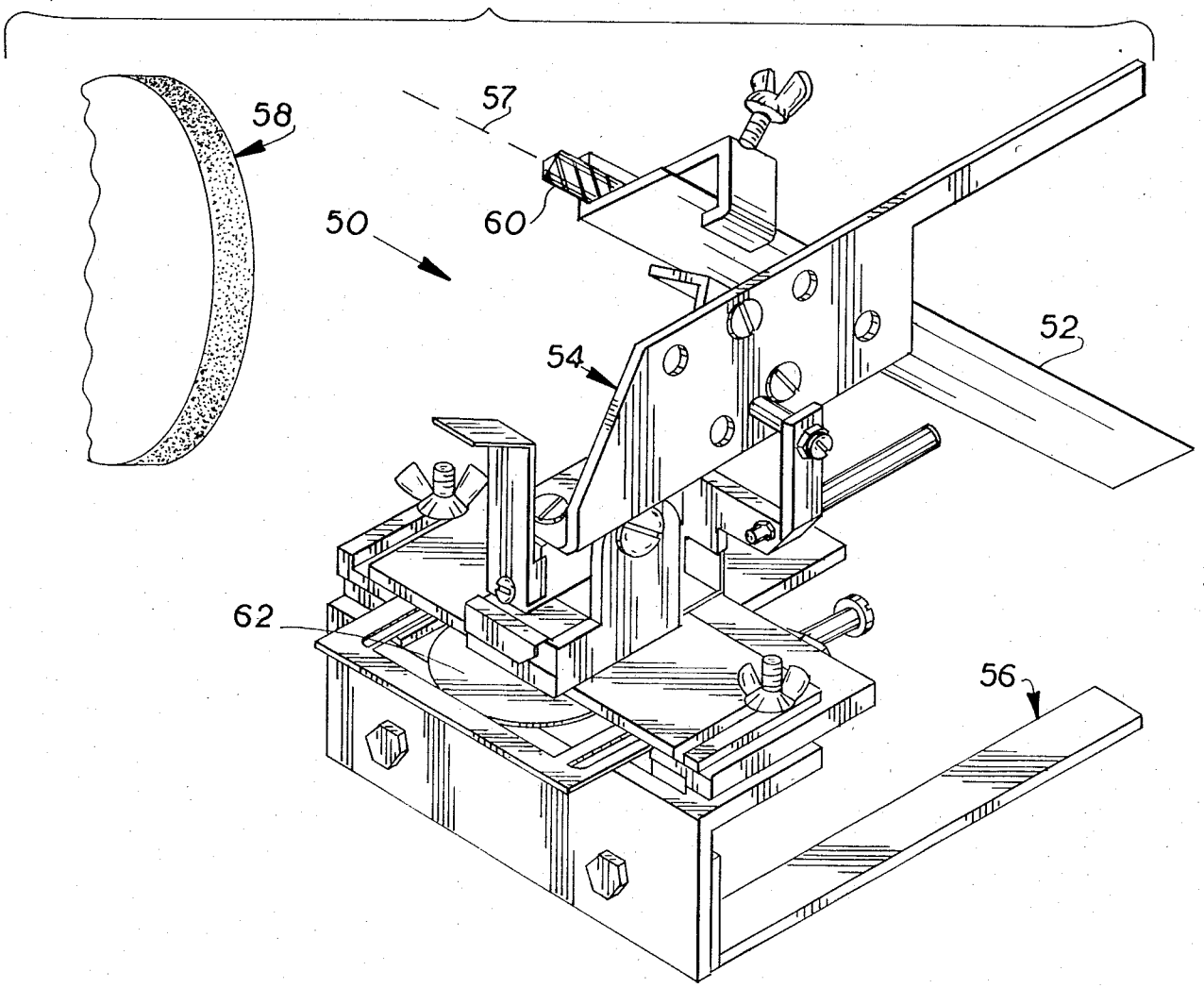
FIG. 5 is a perspective view of the drill bit sharpener shown in U.S. Pat. No. 4,520,599 to the present inventor.

FIG. 5 shows in perspective the drill bit sharpener shown and described in U.S. Pat. No. 4,520,599 to the present inventor. The interested reader is referred to said patent for a full and complete description of the sharpener.

The sharpener 50 includes a cradle means 52, a cradle means holder 54, and a support means 56 that supports the cradle means holder 54. Grinding means 58 is shown spaced forwardly of sharpener 50; it rotates in a plane normal to the longitudinal axis of symmetry 57 of drill bit 60.

Circular disc 62 and its associated parts are replaced by the novel drill bit adjustment means of the present invention.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, migh be said to fall therebetween.

Now that the invention has been described, what is claimed is:

1. An improved apparatus for sharpening a drill bit on a grinding means, of the type in which a cradle means holds the drill bit to be sharpened and in which a cradle means holder holds said cradle means and hence said drill bit in a predetermined angular orientation relating to the point angle of said drill bit, in which a support means for supporting said cradle means holder is moveable in a linear direction away from or toward said grinding means, said grinding means being positioned for rotation in a plane normal to said support means, wherein the improvement comprises:

a travel limiting means that determines the optimal forwardmost position of said support means relative to said grinding means and hence of said drill bit to be sharpened for a given drill bit point angle, said travel limiting means comprising a slideably mounted, elongate spacer member having a plurality of laterally spaced visually detectable markings formed thereon, each of said markings corresponding to a different setting of said travel limiting means, said travel limiting means further comprising a flat plate member having a leading edge positioned parallel to the plane of said grinding means;

said travel limiting means further comprising a pair of laterally spaced pin members fixedly secured to said leading edge of said plate member;

said spacer member further including a leading edge with two inclined portions, the angle of each of said inclined portions corresponding to the angle of the other inclined portion and corresponding to a predetermined distance of each setting of said travel limiting means, wherein said predetermined distance relates to the distance between said support means and said grinding means, a flat base member having a leading edge which slideably abuts a trailing edge of said spacer member;

the position of the leading edge of said plate member being determined by the engagement of said pin members and their associated inclined surfaces which position is indicated by said markings;

and means for releasably securing said plate member into a plurality of functional positions of adjustment.

2. The apparatus of claim 1, wherein said means for releasably securing said plate member comprises a pair of laterally spaced slots formed in said plate member which extend from its trailing edge toward its leading edge and a pair of nut means which when tightened hold said plate member against movement.

3. The apparatus of claim 2 wherein said plate member overlies said base member and said spacer member, and wherein said pin members depend to said plate member.

* * * * *